US006802739B2

(12) United States Patent
Henningsen

(10) Patent No.: US 6,802,739 B2
(45) Date of Patent: Oct. 12, 2004

(54) COAXIAL CABLE CONNECTOR

(75) Inventor: Jimmy Henningsen, Naestved (DK)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 10/346,007

(22) Filed: Jan. 16, 2003

(65) Prior Publication Data

US 2004/0142596 A1 Jul. 22, 2004

(51) Int. Cl.[7] ..... H01R 9/05
(52) U.S. Cl. ..... 439/584; 439/933
(58) Field of Search ..... 439/584, 583, 439/578, 933

(56) References Cited

U.S. PATENT DOCUMENTS

| | | | | |
|---|---|---|---|---|
| 3,836,946 A | | 9/1974 | Geiger | 439/580 |
| 4,662,693 A | | 5/1987 | Hutter et al. | 439/583 |
| 5,595,502 A | * | 1/1997 | Allison | 439/429 |
| 6,008,306 A | | 12/1999 | Hafner et al. | 526/171 |
| 6,120,314 A | * | 9/2000 | Harting et al. | 439/394 |
| 6,386,915 B1 | * | 5/2002 | Nelson | 439/584 |
| 2001/0037607 A1 | * | 11/2001 | Pfieffer et al. | 49/502 |

FOREIGN PATENT DOCUMENTS

| | | |
|---|---|---|
| DE | 1 905 182 | 9/1970 |
| EP | 0 994 527 A1 * | 4/2000 |
| EP | 0 997 482 | 5/2000 |
| EP | 1 028 498 | 8/2000 |
| EP | 1 122 835 | 8/2001 |
| EP | 1 138 595 | 10/2001 |

* cited by examiner

*Primary Examiner*—Javaid H. Nasri
(74) *Attorney, Agent, or Firm*—Joseph M. Homa

(57) ABSTRACT

The invention relates to a connector for a coaxial cable which includes a center terminal with an end portion for connection to the inner conductor of the cable, the end portion having an annular contact surface longitudinally extending over a predefined distance and protruding radially inwardly from an inner circumferential surface to establish electrical and mechanical contact between the center terminal and the inner conductor of the coaxial cable. The dielectric structures in the connector are advantageously made from a material having a dielectric constant less than 3.5.

21 Claims, 3 Drawing Sheets

COAXIAL CABLE CONNECTOR

FIELD OF THE INVENTION

The present invention relates to connectors for coaxial cables, and in particular for connectors having a center terminal that connects with the inner conductor of a coaxial cable.

TECHNICAL BACKGROUND

Mechanically and electrically stable connections between the inner conductor and outer conductor of a coaxial cable and the corresponding inner-terminal (or center-terminal) and main body of the connector are known. These stable connections are typically brought about by axial displacements of the various parts of the connector relative to each other such that these displacements are transformed into corresponding inwardly directed radial displacements of contact surfaces of the connector exerting a sufficiently strong pressure against the corresponding inner and outer conductors of the cable. In order to obtain reliable electrical and mechanical connections, these contact surfaces are furthermore often provided with threads or protrusions which may penetrate the surface of the inner conductor, thereby contributing to increased reliability of the connections.

A number of such connectors are known. For example, EP 0 994 527 by the applicant discloses a coaxial connector provided with threads on the contact surface between the inner conductor of the cable and the center terminal of the connector.

U.S. Pat. No. 5,595,502 discloses a connector for a coaxial cable having a hollow inner conductor, where the center terminal of the connector during mounting of the cable on the connector is brought into the hollow inner conductor, and where the portion of the center terminal inserted into the inner conductor is furthermore provided with threads engaging the inner surface of the hollow conductor.

U.S. Pat. No. 6,120,314 discloses a plug connector for the electrically conductive connection of conductor tracks on a board to at least one coaxial cable where the connector is provided with an insertion duct comprising two tubular sections being able to accommodate the inner- and outer conductor of a coaxial cable, respectively. These sections are both provided with inwardly directed protrusions which during mounting of the cable in the connector are brought to penetrate the insulation material around the inner- and outer conductors, respectively, and exert a strong pressure against the surface of the corresponding conductor.

While the arrangement of protrusions of threads as exemplified by the above disclosures leads to a more stable mechanical attachment of the respective conductor of the cable to the corresponding conductor in the connector, such arrangements may nevertheless be undesirable as they may lead to a deterioration of the transmission of high frequency signals at the contact surfaces between the cable and the connector, especially at the interface between the inner conductor of the cable and the corresponding center terminal of the connector, caused, for instance, by the inner conductor of many known coaxial cables being formed with an aluminum core which is provided with a very thin cladding of another conductive material such as copper. At high frequencies the signal current practically takes place only through the very thin cladding due to the skin effect, and local destruction of this cladding can be caused by penetration of the threads or protrusions leading to local impedance discontinuities which tend to degrade signal transmission. It is hence desirable to provide attachment means, especially between the inner conductor of the cable and the center terminal of the conductor, that attains high stability and reliability of connection without introducing the degradation of the electrical signal.

The application of various supporting structures made of a dielectric material in electrical connectors or coaxial connectors is known, for instance to fix the center terminal of the connector appropriately within the main body of the connector, to transmit pressure between various parts of the connector during mounting of the connector on the cable, and to act as a mechanical abutment or backstop for various displaceable parts of the connector. Very often these structures are exposed to large mechanical stress both in use and during mounting of the connector, and these structures should be able to withstand such stress without unacceptable deformations or failure, often over a wide range of temperatures, humidities and even in the presence of chemical agents that may increase the risk of damage to the structures. Within the art it is known to apply, for instance, PEHD or TPX for such structures, but these materials suffer from a number of drawbacks, such as being too soft to provide a consistent attachment of the center terminal to the main body of the connector.

SUMMARY OF THE INVENTION

An object of the present invention is to provide a connector for a coaxial cable which provides a firm and reliable electrical and mechanical contact between the inner connector of the cable and the center terminal of the connector while reducing the possibility of degradations of signal propagation at the interface between the inner conductor and the center terminal.

In preferred embodiments, the present invention relates to a connector for a coaxial cable, the cable comprising an inner conductor, the connector comprising: a main body having an outer surface and an inner surface defining a generally cylindrical main body chamber; a tubular support member disposed within the main body chamber and having an inner surface defining a generally cylindrical tubular support member chamber; a center terminal member disposed within the inner tubular member chamber, the center terminal member comprising a sleeve portion having an open end adapted to receive the inner conductor of the cable; an axially movable tubular member disposed within the main body chamber; and a tubular outer bushing having one end adapted to receive the coaxial cable and an opposite end capable of engaging the main body, wherein the tubular outer bushing is capable of axially displacing the axially movable tubular member within the main body chamber. Relative axial movement between the main body and the tubular outer bushing causes the axially movable tubular member to deflect the sleeve portion of the center terminal member radially inwardly, thereby causing the sleeve portion to engage the inner conductor of the terminal. The sleeve portion may further comprise a reduced thickness portion adjacent the protrusion.

In a preferred embodiment, the sleeve portion of the center terminal member has a protrusion extending radially inwardly and having a contact surface for contacting the inner conductor of the cable. Preferably, the protrusion of the sleeve portion has an edge adapted to anchor the protrusion on the surface of the inner conductor of the cable, thereby resisting relative axial movement of the cable with respect to the connector. Preferably, the protrusion has a distal end surface adapted to reduce frictional resistance to the insertion of the inner conductor of the cable into the sleeve portion. Preferably, the sleeve portion of the center terminal member has a beveled surface facing radially outwardly for engaging the axially movable tubular member. Preferably, the axially movable tubular member has a mating beveled surface adapted to engage the beveled surface of the sleeve portion.

In a preferred embodiment, the sleeve portion comprises at least one longitudinal slit.

Preferably, the connector further comprises a ferrule disposed within the tubular outer bushing, wherein the ferrule is adapted to engage the outer conductor of the cable. Preferably, the ferrule is capable of contacting the axially movable tubular member and the tubular outer bushing, wherein relative axial movement between the main body and the tubular outer bushing is capable of causing the ferrule to contact the outer conductor of the cable and the main body.

Preferably, the connector further comprises a tubular inner bushing adapted to surround a portion of the inner conductor of the cable and to reside within a portion of the cable disposed radially outwardly from the inner conductor of the cable. Preferably, the tubular inner bushing comprises an end capable of radially supporting a portion of the ferrule. Preferably, the tubular inner bushing has an end capable of contacting and axially displacing the axially movable tubular member upon relative axial movement between the main body and the outer tubular bushing.

Preferably, at least one of the tubular support member, the axially movable tubular member, and the tubular outer bushing is made from a dielectric material comprising cycloolefincopolymer. Preferably, the cycloolefincopolymer is an amorphous, transparent copolymer based on cyclic and linear olefins according to the formula

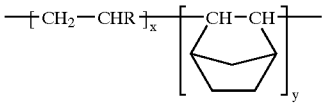

Preferably, the dielectric constant of the dielectric material is less than 3.5. Even more preferably, the dielectric constant of the dielectric material is less than 2.5.

In other preferred embodiments, the present invention relates to a method of forming a coaxial connector to be attached to a coaxial cable, the method comprising: forming a dielectric structure from cycloolefincopolymer, the dielectric structure being adapted to receive the coaxial cable; providing a support structure for supporting the dielectric structure; and assembling the support structure and the dielectric structure to form the coaxial connector. Preferably, the cycloolefincopolymer is an amorphous, transparent copolymer based on cyclic and linear olefins according to the formula

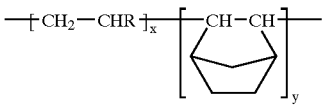

Preferably, the dielectric constant of the dielectric structure is less than 3.5. Even more preferably, the dielectric constant of the dielectric structure is less than 2.5. In a preferred embodiment, the cable comprises an inner conductor, and the connector comprises: a main body having an outer surface and an inner surface defining a generally cylindrical main body chamber; a tubular support member disposed within the main body chamber and having an inner surface defining a generally cylindrical tubular support member chamber; a center terminal member disposed within the inner tubular member chamber, the center terminal member comprising a sleeve portion having an open end adapted to receive the inner conductor of the cable; an axially movable tubular member disposed within the main body chamber; and a tubular outer bushing having one end adapted to receive the coaxial cable and an opposite end capable of engaging the main body, wherein the tubular outer bushing is capable of axially displacing the axially movable tubular member within the main body chamber; and the dielectric structure is at least one of the tubular support member, the axially movable tubular member, and the tubular outer bushing.

In a preferred embodiment, the present invention relates to a connector for a coaxial cable which includes a center terminal with an end portion for connection to the inner conductor of the cable, the end portion having an annular contact surface longitudinally extending over a predefined distance and protruding radially inwardly from an inner circumferential surface to establish electrical and mechanical contact between the center terminal and the inner conductor of the coaxial cable. The dielectric structures in the connector are advantageously made from a material having a dielectric constant less than 3.5.

Reference will now be made in detail to the present preferred embodiments of the invention, examples of which are illustrated in the accompanying drawings. An exemplary embodiment of a segmented core refractive index profile in accordance with the present invention is shown in each of the figures.

BRIEF DESCRIPTION OF THE DRAWINGS

The invention will now be described in more detail with reference to the accompanying drawings, in which.

DETAILED DESCRIPTION OF THE PREFERRED EMBODIMENT

Figure 1:
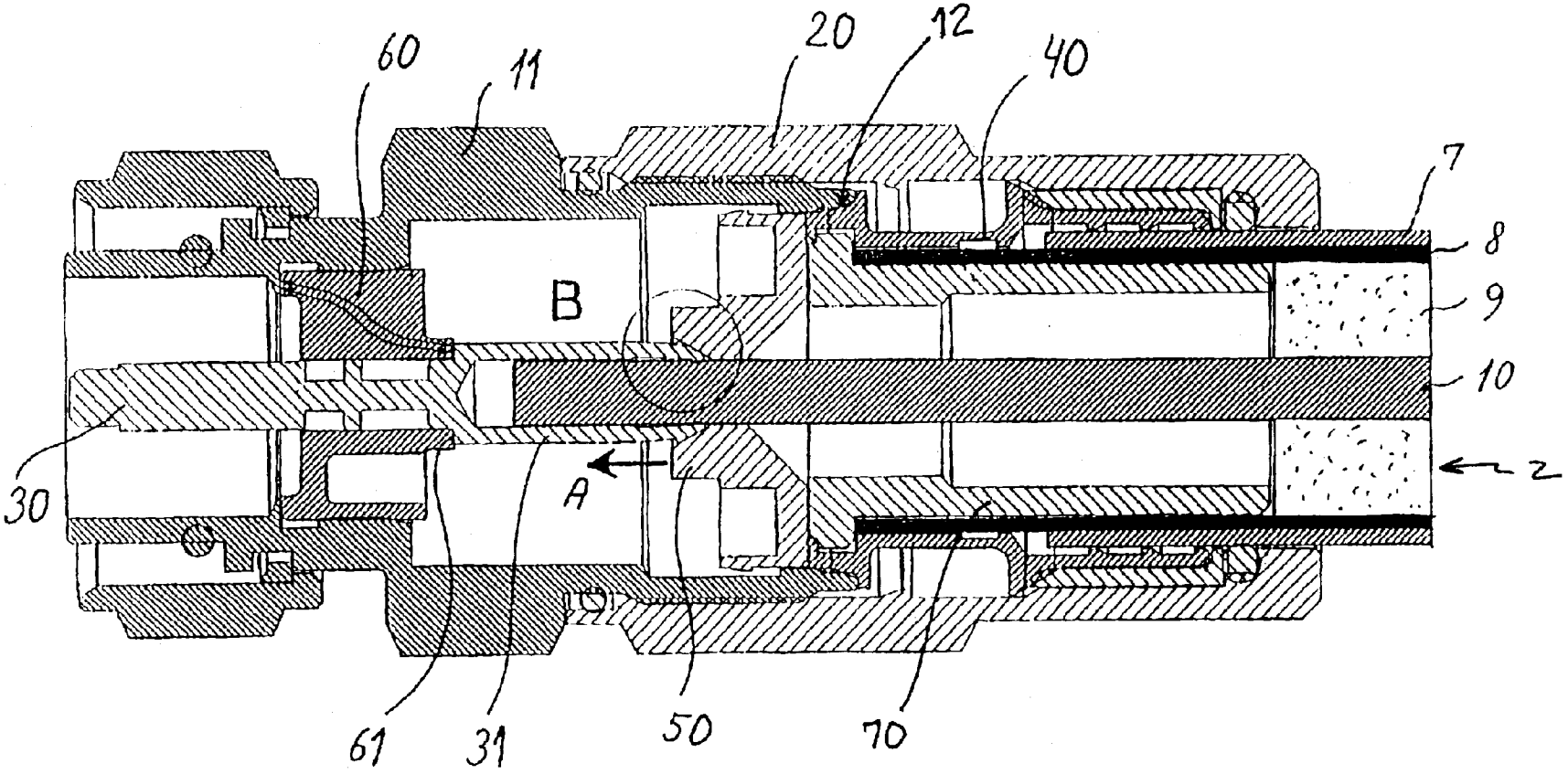
FIG. 1 is a longitudinal cross-sectional view through a connector according to the invention.

Additional features and advantages of the invention will be set forth in the detailed description which follows and will be apparent to those skilled in the art from the description or recognized by practicing the invention as described in the following description together with the claims and appended drawings.

According to one preferred embodiment of the present invention a connector for a coaxial cable comprises an outer bushing for providing an axial displacement of parts in the connector, whereby these parts are brought into mechanical and electrical engagement with the coaxial cable, the axial displacement being provided by screwing a thread provided on said bushing onto a corresponding thread provided on the main body of the connector, the connector being furthermore provided with a center terminal attached to the main body of the connector via a tubular member and comprising an end portion for connection to the inner conductor of the cable, said end portion being provided with engagement means for engagement with corresponding engagement means provided on a tubular body coaxially and displaceably mounted in the connector, and where said end portion is a tubular body longitudinally provided with a number of slits facilitating the axial compression of the end portion around the inner conductor of the cable, and where the connector is furthermore characterized in that said end portion on the inner circumferential surface hereof is provided with an annular contact surface longitudinally extending over a predefined distance and protruding radially inwardly from said inner circumferential surface to establishment of a firm and reliable electrical and mechanical contact between the center terminal and the inner conductor of the coaxial cable.

Various parameters are important in connection with the above mentioned structures in a connector, including the dielectric properties (dielectric constant) and the mechanical properties such as hardness, dimensional stability and impact resistance. Furthermore, the connector structure preferably withstands the influence of chemical agents that could potentially be present in those environments in which the connector is used. In use, the various parameters must be kept within acceptable ranges for ranges in such factors as temperature and relative humidity.

From an electrical point of view it is desirable that the dielectric constant of the connector, and in particular the dielectric constant of the support structure between the center terminal and the main body of the connector, be kept as low as possible, because a large dielectric constant of the material of this structure will lead to a relatively high capacitance between the center terminal and the main body thereby reducing the upper limiting frequency for signal transmission through the connector. For connectors used in high frequency transmission systems this factor is vitally important.

A coaxial connector is disclosed herein comprising a main body for connection to the outer conductor of a coaxial cable and a center terminal for connection to the inner conductor of the cable. Preferably, as disclosed herein, the dielectric support structure for attachment of the center terminal to the main body of this connector is made of COC. Other dielectric structures of the connector could also be made of this material.

FIG. 1 shows a connector as disclosed herein for a coaxial cable 2. Typically, cable 2 comprises a jacket 7, which surrounds an outer conductor 8, which surrounds a dielectric material 9, which surrounds an inner conductor 10. The connector comprises a tubular main body 11 upon which a tubular outer bushing 20 is attached preferably by means of threads provided on the outer surface of a portion of the main body 11 and on a corresponding inner surface of the outer bushing 20 thus providing the possibility to axially displace the main body 11 and the outer bushing 20 relative to each other.

The main body 11 is preferably electrically connected to the outer conductor 8 of the cable 2, preferably by an electrically conductive ferrule 40 exerting a preferably high pressure radially inwardly on both the outer conductor 8 and on the jacket 7 of the cable 2. A tubular bushing 70 is provided as a mechanical backstop inwardly of the outer conductor 8 and coaxial with the cable 2. Preferably the tubular bushing 70 is made of a material of sufficient radial rigidity to withstand the pressure from the ferrule 40. Electrical contact between the ferrule 40 and the main body 11 is provided along the contact surface 12. The connector is furthermore provided with a center terminal 30 to be connected electrically to the inner conductor 10 of the cable 2. Center terminal 30 comprises a hollow, tubular end portion 31 adapted to undergo a radial compression around the end of the inner conductor 10. Tubular support member 60 made of a dielectric material maintains the center terminal 30 in a fixed radial and axial relationship to the main body 11. The radial compression of the end portion 31 of the center terminal 30 occurs during the mounting of the connector on the cable 2 brought about by means of a tubular member 50 for transmission of axial force between the left (as seen in the figure) end of the bushing 70 and the conical end face 120 of the end portion 31 of the center terminal 30. Thus an axial displacement of the bushing 70 causes a radial compression of the end portion 31 whereby a firm electrical and mechanical connection between the center terminal 30 and the inner conductor 10 is obtained.

Figure 2:
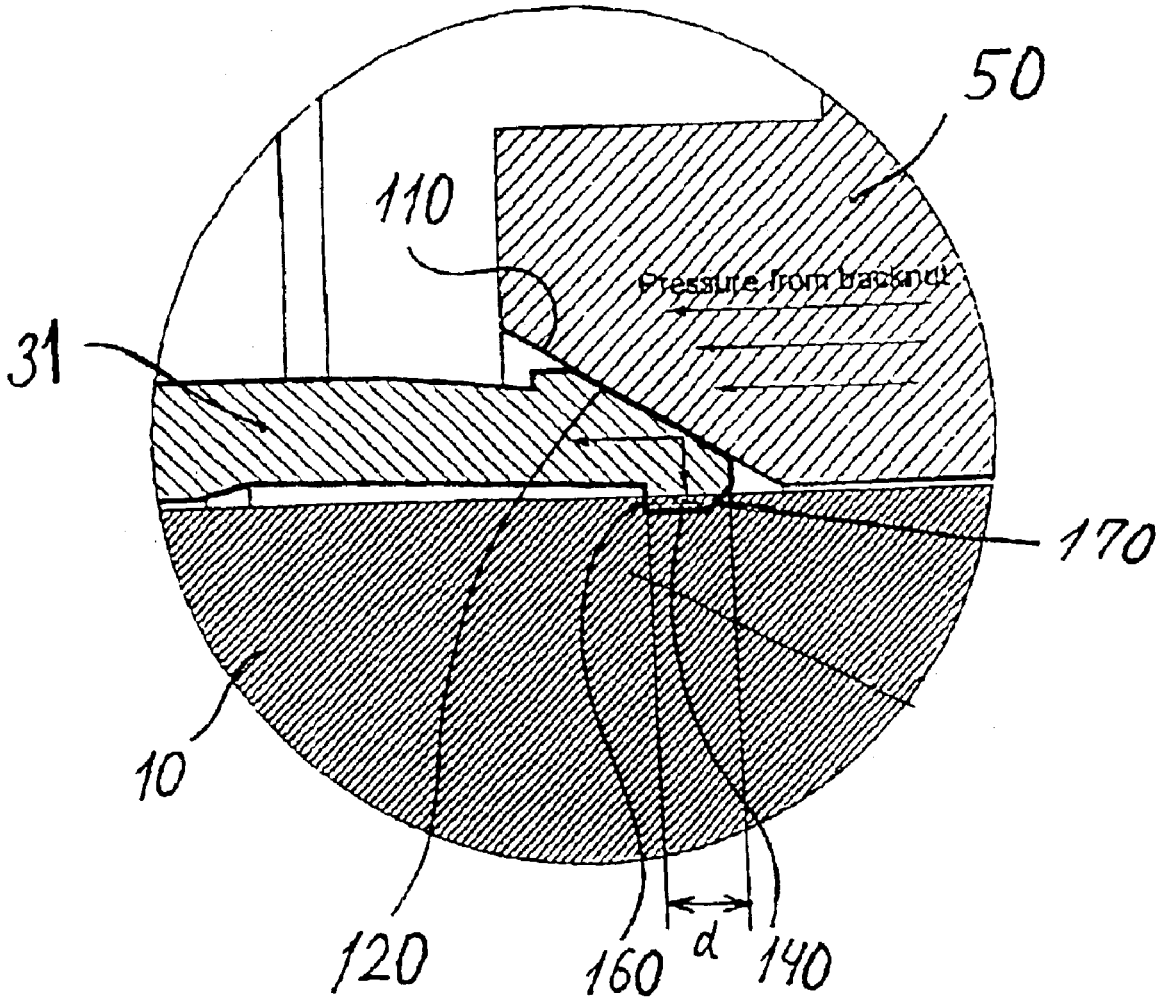
FIG. 2 is a detailed view showing a part of the interface between the center terminal of the connector and the inner conductor of the cable.

One effect of providing the displacement between the main body 11 and the outer bushing 20 is that the tubular member or axially displaceable part 50 surrounding the inner conductor 10 of the cable 2 will be displaced in the direction towards the center terminal 30 as indicated by the arrow A in FIG. 1. Referring to FIGS. 1 and 2, due to the engagement between the conical face 110 of the displaceable part 50 and a corresponding conical face 120 on the end portion 31 of the center terminal 30, the end portion 31 will be pressed radially inwards towards the inner conductor 10, the end portion 31 being axially retained by engagement with a shoulder portion 61 of tubular member 60 by means of which the center terminal 30 of the connector is attached to the main body 11.

Figure 3:
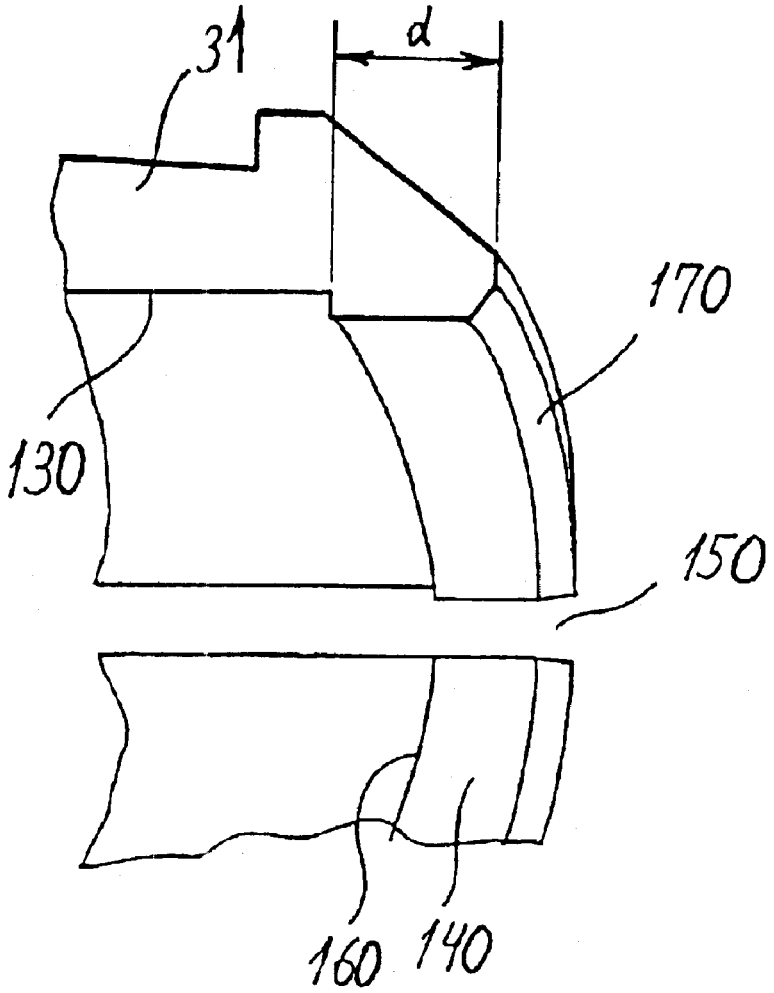
FIG. 3 is a perspective view of a detail of the center terminal shown in FIGS. 1 and 2.

With reference to FIGS. 2 and 3, the end portion 31 of the center terminal 30 according to this preferred embodiment is formed as a tubular member of an inner diameter that, over at least part of the longitudinal length of the end portion 31 and preferably over a majority of the longitudinal length of the end portion 31, is somewhat larger than the diameter of the inner conductor 10 of the coaxial cable 2. During mounting of the connector on the cable 2, the inner conductor 10 is inserted into this tubular end portion 31 of the center terminal 30 approximately as shown in FIG. 1. As seen in FIG. 3, the tubular end portion 31 is provided with a plurality of longitudinally extending slits 150, preferably four slits, although other numbers could also be used. The presence of these slits 150 facilitates the inwardly directed compression of the end portion 31 around the inner conductor 10. At the end of the end portion 31 facing the coaxial cable 2, i.e. to the right in FIGS. 1 and 2, the tubular end portion 31 has on its inner circumferential surface 130 an annular protruding contact area 140 at least partially encircling the inner conductor 10. The inner diameter of this protruding contact area 140 is chosen such that it is possible during mounting of the connector on the cable 2 to pass the inner conductor 10 longitudinally across this contact area 140 and further into the end portion 31 of center terminal 30 to a final position as for instance indicated in FIG. 1. The insertion of the inner conductor 10 of the cable into the end portion 31 is furthermore facilitated by the presence of the inclined end face 170 on the end portion 31.

When the connector is mounted on the cable 2, the above described longitudinal displacement of the axially displaceable part 50 over the end of the end portion 31 will result in the contact surface 140 being pressed against the inner conductor 10 of the cable, thereby depressing the surface of the inner conductor 10, however, without the contact surface 140 penetrating any coating present on the outer circumferential surface of the inner conductor 10. Thus, a firm and reliable electrical and mechanical contact between the center terminal 30 and the inner conductor 10 can be established without the risk of interfering with the high frequency signal propagation from the inner conductor 10 to the center terminal 30 as described initially. Furthermore, the presence of the back face 160 of the contact area 140 provides a firm grip on the inner conductor 10, if for instance, an attempt is made to pull the connector off the cable.

Both during use and during mounting of the connector on the cable the dielectric components 50, 60, and 70 likely would be subjected to large forces.

Most preferably, the dielectric components are made from a material having both a low dielectric constant, i.e. a dielectric constant relatively close to unity, and mechanical characteristics such as hardness and dimensional stability over the required ranges of temperature, humidity, and other ranges in conditions, and additionally which can also withstand the presence of various chemical agents present in the environment where the connector is to be utilized.

In a preferred embodiment, the tubular support member 60 of the connector disclosed herein is made from the COC material provided by Ticona GmBH under the trademark "TOPAS®" and commercially available under a number of different product numbers covering different operational temperature ranges. The trademark TOPAS which is an abbreviation for "Thermoplastisches Olefin-Polymer amorper Struktur" (or thermoplastic olefin-polymer of amorphous structure). A cycloolefincopolymer (COC) of this kind is generally defined by the chemical formula:

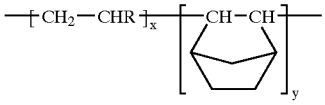

The above COC material is characterized by a number of desirable properties both relating to mechanical and electrical (dielectric) characteristics. During construction of the connector as well as in use, it is essential that the center terminal 30 remains at, as precise as possible, a fixed position coaxial within the main body of the connector. The material of the tubular support member 60 must ensure a high dimensional stability of this member over a wide temperature range. The above mentioned material has a sufficient dimensional stability to temperatures up to 170° C., which ensures that the center terminal 30 will not undergo an unacceptable displacement in the support member 60. Due to the amorphous structure of this material, TOPAS Type 5013 and Type 6013 are preferred to maintain dimensions, rigidity, and tensile strength over the temperature range −50 to +130° C., whereas TOPAS Type 6015 and Type 6017 are preferred for the temperature range −50 to +150° C. TOPAS Type 8007 is preferred for the temperature range of −50 to +70° C.

The high rigidity of the COC material ensures that the center terminal 30 remains centered coaxially within the main body 11 of the connector, which is important in order to maintain the correct electrical impedance of the connector. It is furthermore important to maintain correct centering of the center terminal 30 to facilitate proper connection between the center terminal 30 and the inner conductor 10 of the cable during mounting of the connector on the cable 2.

Dielectric materials with acceptable mechanical and chemical properties previously used in known connectors have an unacceptably high dielectric constant, typically on the order of 3.7. For high frequency applications it is vitally important to keep the dielectric constant as close to unity as possible in order to obtain the highest possible upper limiting frequency of the connector. A number of dielectric materials exist having relatively low dielectric constants, i.e. dielectric constants on the order of 2 to 2.3, but these previously used materials are all very soft and hence not suitable for those dielectric structures in connectors that must be able to withstand large forces during mounting and use of the connectors. Materials such as ABS, Nylon and polycarbonate have dielectric constants on the order of 3.1 to 3.7 and are relatively hard materials, however, the thermal properties of these materials are inferior to COC as implemented in a coaxial cable connector as described herein. For high frequency applications, the dielectric constant is preferably below 3.5 and more preferably below 2.5. The dielectric constant of commercially available COC material is about 2.35. Furthermore, a high degree of dimensional stability makes the COC material advantageous during molding of the members 50, 60, and 70, for example by facilitating the attainment of required tolerances.

The COC material furthermore exhibits a number of advantageous chemical properties. For example, COC is particularly resistant to the effect of isopropanole (which is used for the removal of flooding compound), suds (used as cooling agents during production), hydrochloric acid, sulfuric acid, nitric acid, methanol, ethanol, and acetone. Type 6013 of the above COC material is preferred due to its chemical purity and dimensional stability up to 130 degrees centigrade, which is advantageous under circumstances where sterilization using water vapor, hot air, ethylene oxide gas, and gamma- and beta rays must be carried out. Furthermore COC material can be dyed, for instance to fulfill the requirements of particular users.

COC exhibits very low water absorption (0.01% at 23° C. over 24 hours), wherein the water absorption is a factor of 4 lower than for polycarbonate and approximately a factor of 10 lower than for PMMA. COC is furthermore hydrophobic, and changes in humidity of the surroundings do not appreciably affect the mechanical properties. COC Types 5013 and 6013 can furthermore withstand water vapor at temperatures up to 121° C., and Type 6015 can withstand water vapor at temperatures up to 143° C.

It is to be understood that the foregoing description is exemplary of the invention only and is intended to provide an overview for the understanding of the nature and character of the invention as it is defined by the claims. The accompanying drawings are included to provide a further understanding of the invention and are incorporated and constitute part of this specification. The drawings illustrate various features and embodiments of the invention which, together with their description, serve to explain the principles and operation of the invention. It will become apparent to those skilled in the art that various modifications to the preferred embodiment of the invention as described herein can be made without departing from the spirit or scope of the invention as defined by the appended claims.

What is claimed is:

1. A connector for a coaxial cable, the cable comprising an inner conductor, the connector comprising:

a main body having an outer surface and an inner surface defining a generally cylindrical main body chamber;

a tubular support member disposed within the main body chamber and having an inner surface defining a generally cylindrical tubular support member chamber;

a center terminal member disposed within the inner tubular member chamber, the center terminal member comprising a sleeve portion having an open end adapted to receive the inner conductor of the cable;

an axially movable tubular member disposed within the main body chamber; and a tubular outer bushing having one end adapted to receive the coaxial cable and an opposite end capable of engaging the main body, wherein the tubular outer bushing is capable of axially displacing the axially movable tubular member within the main body chamber;

wherein relative axial movement between the main body and the tubular outer bushing causes the axially movable tubular member to deflect the sleeve portion of the center terminal member radially inwardly, thereby causing the sleeve portion to engage the inner conductor of the terminal.

2. The connector of claim 1 wherein the sleeve portion of the center terminal member has a protrusion extending radially inwardly and having a contact surface for contacting the inner conductor of the cable.

3. The connector of claim 2 wherein the protrusion of the sleeve portion has a back face adapted to grip the inner conductor of the cable, thereby resisting relative axial movement of the cable with respect to the connector.

4. The connector of claim 2 wherein the protrusion has a distal end surface adapted to reduce frictional resistance to the insertion of the inner conductor of the cable into the sleeve portion.

5. The connector of claim 1 wherein the sleeve portion of the center terminal member has a beveled surface facing radially outwardly for engaging the axially movable tubular member.

6. The connector of claim 5 wherein the axially movable tubular member has a mating beveled surface adapted to engage the beveled surface of the sleeve portion.

7. The connector of claim 1 wherein the sleeve portion comprises at least one longitudinal slit.

8. The connector of claim 2 wherein the sleeve portion further comprises a reduced thickness portion adjacent the protrusion.

9. The connector of claim 1 further comprising a ferrule disposed within the tubular outer bushing, wherein the ferrule is adapted to engage the outer conductor of the cable.

10. The connector of claim 9 wherein the ferrule is capable of contacting the axially movable tubular member and the tubular outer bushing, wherein relative axial movement between the main body and the tubular outer bushing is capable of causing the ferrule to contact the outer conductor of the cable and the main body.

11. The connector of claim 1 further comprising a tubular inner bushing adapted to surround a portion of the inner conductor of the cable and to reside within a portion of the cable disposed radially outwardly from the inner conductor of the cable.

12. The connector of claim 11 wherein the tubular inner bushing comprises an end capable of radially supporting a portion of a ferrule disposed within the tubular outer bushing.

13. The connector of claim 11 wherein the tubular inner bushing has an end capable of contacting and axially displacing the axially movable tubular member upon relative axial movement between the main body and the outer tubular bushing.

14. The connector of claim 1 wherein at least one of the tubular support member, the axially movable tubular member, and the tubular outer bushing is made from a dielectric material comprising cycloolefincopolymer.

15. The connector of claim 14 wherein the cycloolefincopolymer is an amorphous, transparent copolymer based on cyclic and linear olefins according to the formula

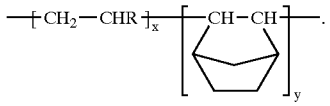

16. The connector of claim 14 wherein the dielectric constant of the dielectric material is less than 3.5.

17. The connection of claim 14 wherein the dielectric constant of the dielectric material is less than 2.5.

18. A method of forming a coaxial connector to be attached to a coaxial cable, the method comprising:

providing a main body having an outer surface and an inner surface defining a generally cylindrical main body chamber;

providing a tubular support member disposed within the main body chamber and having an inner surface defining a generally cylindrical tubular support member chamber;

providing a center terminal member disposed within the inner tubular member chamber, the center terminal member comprising a sleeve portion having an open end adapted to receive the inner conductor of the cable;

providing an axially movable tubular member disposed within the main body chamber; and providing a tubular outer bushing having one end adapted to receive the coaxial cable and an opposite end capable of engaging the main body, wherein the tubular outer bushing is capable of axially displacing the axially movable tubular member within the main body chamber, wherein at least one of the tubular support member, the axially movable tubular member, and the tubular outer bushing is made from a dielectric material comprising cycloolefincopolymer; and assembling the main body, the tubular support member, the center terminal member, the axially movable tubular member, and the tubular outer bushing into the coaxial connector.

19. The method according to claim 18 wherein said cycloolefincopolymer is an amorphous, transparent copolymer based on cyclic and linear olefins according to the formula

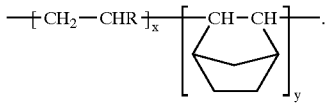

20. The method according to claim 18 wherein the dielectric constant of the dielectric structure is less than 3.5.

21. The method according to claim 18 wherein the dielectric constant of the dielectric structure is less than 2.5.

* * * * *